United States Patent [19]

Papst

[11] 4,167,376

[45] Sep. 11, 1979

[54] AXIAL FAN

[75] Inventor: Hermann Papst, St. Georgen, Fed. Rep. of Germany

[73] Assignee: Papst-Motoren KG, St. Georgen, Fed. Rep. of Germany

[21] Appl. No.: 798,924

[22] Filed: May 20, 1977

[30] Foreign Application Priority Data

Nov. 19, 1976 [DE] Fed. Rep. of Germany ..... 2652642

[51] Int. Cl.[2] ..... F04B 35/04

[52] U.S. Cl. ..... 417/354; 415/192

[58] Field of Search ..... 417/353, 352, 354, 355; 415/183, 191, 192, 195, 217

[56] References Cited

U.S. PATENT DOCUMENTS

| | | | |
|---|---|---|---|
| 442,614 | 12/1890 | Dock | 415/191 X |
| 1,906,408 | 5/1933 | Persons | 415/183 |
| 2,146,339 | 2/1939 | Jackson | 415/217 |
| 2,622,790 | 12/1952 | McLeod | 415/217 UX |
| 2,735,612 | 2/1956 | Hausmann | 415/183 UX |
| 3,270,677 | 9/1966 | Eller et al. | 415/195 |
| 3,362,627 | 1/1968 | Papst | 417/354 |

*Primary Examiner*—Carlton R. Croyle
*Assistant Examiner*—R. E. Gluck
*Attorney, Agent, or Firm*—Michael J. Striker

[57] ABSTRACT

The fan housing has a generally circular outer peripheral contour and is provided with a plurality of substantially identical equally spaced radial projections and has at each axial end of the housing a boundary surface and including a tubular part extending in the axial direction of the fan housing intermediate the two aforementioned boundary surfaces. A drive motor is centrally mounted by radial spokes at one axial end of the fan. A fan wheel driven by the motor at least partly surrounds the motor and is provided with fan blades accommodated in an annular flow channel defined intermediate the tubular part of the fan housing and the drive motor. The fan blades extend substantially all the way to the other axial end of the tubular part of the fan housing. The tubular part at its middle has a circular interior cross-section closely surrounding the outer peripheral boundary surface of the fan wheel. The radial projections are located at at least one of the two axial ends of the fan, and the tubular part merges into them. The inner wall of the tubular part in the vicinity of the radial projections is set back radially outward from the outer peripheral boundary surface of the fan blades but is confined within the outer boundary surface of the fan housing. Stationary flow-guiding elements are provided on the set back parts of the tubular part of the fan housing.

10 Claims, 17 Drawing Figures

AXIAL FAN

BACKGROUND OF THE INVENTION

The invention relates to an axial fan the housing of which, as viewed in the axial direction, has the external contour of a circle with uniformly circumferentially spaced identical radial projections, with a tubular part being arranged between the two axial boundary surfaces of the fan housing. A drive motor is mounted by means of spokes at one axial end of the housing. The drive motor drives a fan wheel which at least partly surrounds the drive motor. The blades of the fan wheel extend, within an annular flow channel defined between the drive motor and the tubular part, to about the other axial end of the tubular part of the fan housing. The tubular part, approximately midway between the axial ends thereof, has a circular interior cross-section which very closely surrounds the peripheral boundary contour of the fan wheel. At at least one axial end of the tubular part, the latter merges into the radial projections which are distributed uniformly about the circumference of the tubular part. In the region of those projections, the inner wall of the tubular part is set back from the peripheral boundary surface of the fan wheel interiorly of the external contour of the housing of the axial fan.

In particular, the invention is concerned with maximum utilization of the usually parallelepiped space defined by the external surfaces of the axial fan, in order to improve the performance of the fan, e.g., its air throughput. To this end, the projections or flared enlargements, particularly if these projections are located on the discharge side of the fan, make possible a considerable improvement in the performance of the fan, within the framework of the external contours in question.

SUMMARY OF THE INVENTION

An object of the invention, in addition to the foregoing, is to improve the performance (e.g., air throughput) of such an axial fan, while respecting the limited space defined by the external contour in question.

According to one concept of the invention, the air-throughput capacity of the fan is significantly improved by providing the aforementioned set back portions of the tubular part with stationary flow guide elements which cause the air flow effected by the aforementioned projections or enlargements to describe a more advantageous and effective path of travel than hitherto.

It has proved very advantageous to provide the tubular part of the axial fan with a waist which narrows toward the outer peripheral contour of the fan wheel. In this way, there will be created, to one or to both axial sides of the waist, diffusor-like annular intermediate spaces. According to a further concept of the invention, the flow guiding elements provided in the flared enlargements of the tubular part can extend into these intermediate spaces, which still further improves their contribution to the air-moving action.

According to another advantageous concept of the invention, the circular internal cross-section of the tubular part of the fan housing very closely surrounds the outer peripheral contour of the fan wheel, at least from a portion midway between the axial ends of the tubular part toward and as far as possible to the discharge-side boundary surface of the housing, except in the region of the flow-guiding elements. In particular the inner wall of the tubular part of the housing is cylindrical and the external contour of the housing substantially circumscribes this cylinder.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
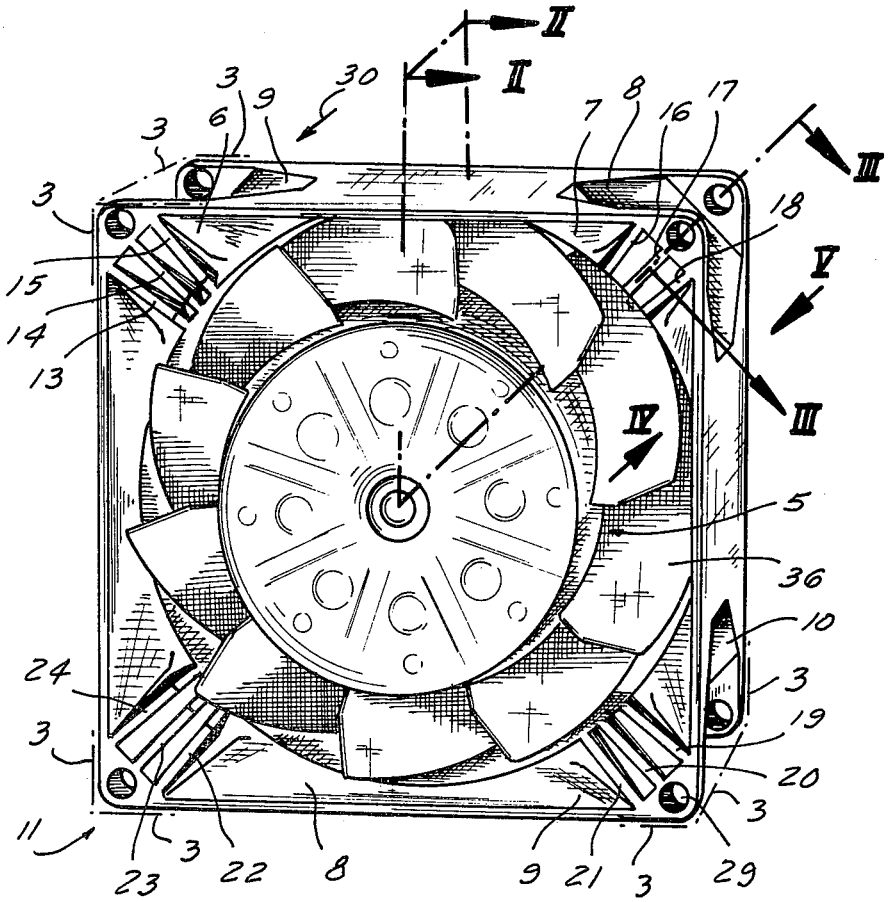
FIG. 1 is a perspective view of an exemplary embodiment of an axial fan designed in accordance with the inventive concepts.
Figure 2:
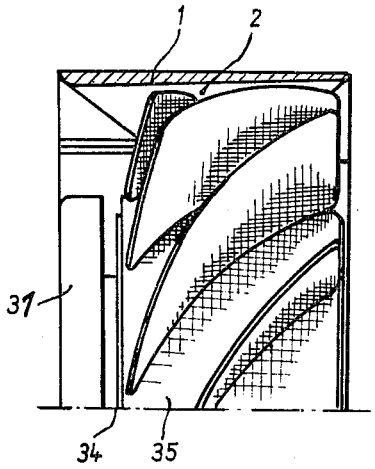
FIG. 2 is a sectional view, taken along sectioning plane II—II of FIG. 1, through the for the most part tubular housing of FIG. 1, with the fan wheel and central flange of the fan construction shown non-sectioned, the view extending downward only to the central axis of the fan.

In all Figures, including sectional views, the fan wheel with its blades is shown non-sectioned, for the sake of simplicity.

FIGS. 1–5 depict a first embodiment. Numeral 1 denotes the tubular part of the fan which surrounds the flow passage 2 of the fan. This tubular part 1 fits within a parallelepiped whose edges are indicated by the dash-dot lines 3 in FIG. 1. This parallelepiped includes two quadratic major boundary surfaces, of which in FIG. 1 the one faces towards the viewer and the other faces away from the viewer, as well as four lateral boundary surfaces each in the form of an elongated rectangle. This parallelepiped bounds the space taken up by axial fan itself. The tubular part 1, at the portion thereof midway between its axial ends, indicated by double-arrow 4 in FIG. 3, has a circular interior cross-section which surrounds the outer peripheral contour of the fan wheel 5 mounted within the tubular part 1.

At each of its axial ends, the tubular part 1 is provided with four flared enlargements 6–9, each one projecting into a respective corner of the parallelepiped; at these enlargements, the wall of the tubular part 1 is increasingly set back (radially outward) from the outer peripheral contour 12 (FIG. 4) of the fan wheel 5, as one proceeds axially toward the axial end of the tubular part 1, while at the same time remaining within the confines of the parallelepiped in question. This creates at each of the four corners on both axial sides of the fan a diffusor-like space for the fan air flow. Accommodated within these diffusor-like spaces are stationary flow-guiding walls secured or actually of one piece with the tubular part 1. In FIG. 1, at the side of the fan facing the viewer, there are provided three such flow-guiding elements in each corner of the fan, for a total of twelve, and these are denoted by numerals 13–24. At the side of the fan facing away from the viewer, there are provided a corresponding number of flow-guiding elements, of which, however, in FIGS. 3 and 5 only the flow-guiding elements 26, 27, 28 of one corner can be seen. These flow-guiding elements are so arranged as to define between themselves intermediate flow channels which extend in the direction desired for the air flow at such portions of the fan.

Figure 3:
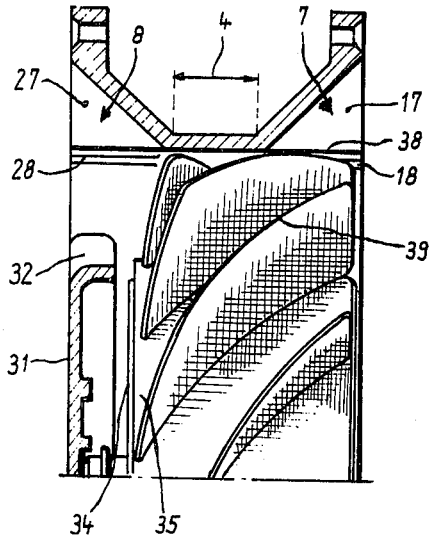
FIG. 3 is a sectional view, taken along sectioning plane III—III of FIG. 1, through the construction of FIG. 1, but with the fan wheel being shown non-sectioned.
Figure 4:
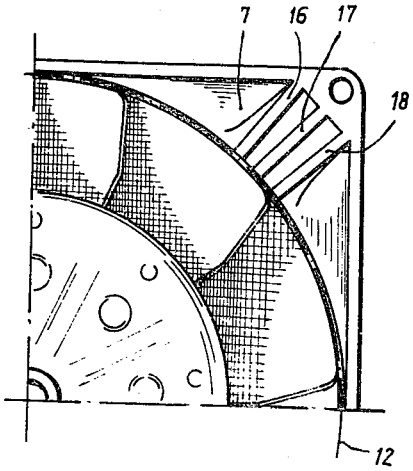
FIG. 4 depicts the quadrant of the construction of FIG. 1 indicated by arrow IV in FIG. 1, as viewed from the front in FIG. 1.
Figure 5:
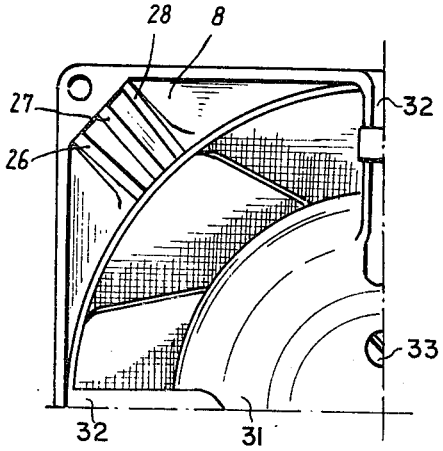
FIG. 5 depicts the quadrant of the construction of FIG. 1 indicated by the arrow V in FIG. 1, as viewed from the back in FIG. 1.

As can be seen in FIG. 3, the cross-section of the flow-guiding elements increases in the axially outward direction, in order to utilize as fully as possible the additional space available at the corners of the construction.

At each of the axial ends of the fan, the four corners of the fan are provided with mounting holes 29. Mounting holes 29 serve to receive mounting screws. Advantageously, the flow-guiding elements provided at the corners of the fans additionally serve to strengthen and reinforce the flared enlargements of the tubular part 1, so that the construction can the better withstand the stresses to which it may be subject when the fan is mounted and the mounting screws are in tightened condition.

The flow direction of the air moved by the fan is indicated by arrow 30 in FIG. 1. In FIG. 1, the suction side of the fan faces away from the viewer, whereas the discharge side faces toward the viewer. At the axial end of the tubular part 1 at the suction side of the fan, there is provided a central flange 31 which is mounted on spokes 32 secured to the tubular part 1. The central flange 31 lies along the adjoining major quadratic surface of the parallelepiped, but is in its entirety located interiorly of that surface. A total of four such spokes 32 are provided, angularly spaced from one another by 90°, two such spokes 32 being most clearly seen in FIG. 5. An external-rotor drive motor is mounted on the flange 31 by means of screws. One of the mounting screws 33 is visible in FIG. 5. The stator 34 of the motor is partly seen in FIGS. 2 and 3, but is substantially completely surrounded and blocked from view by the external rotor 35. The fan blades 36 are welded to the outer peripheral surface of the external rotor 35 and form therewith the fan wheel 5.

Figure 6:
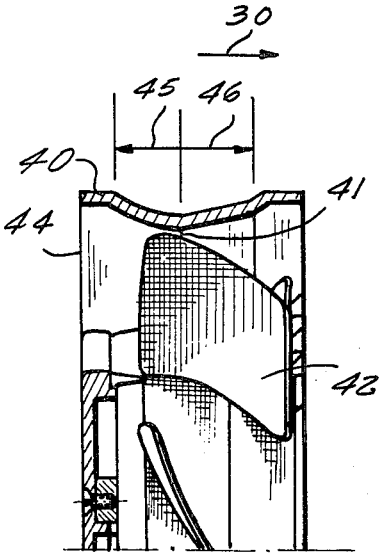
FIG. 6 is a view corresponding to FIG. 2, but of a second embodiment.
Figure 7:
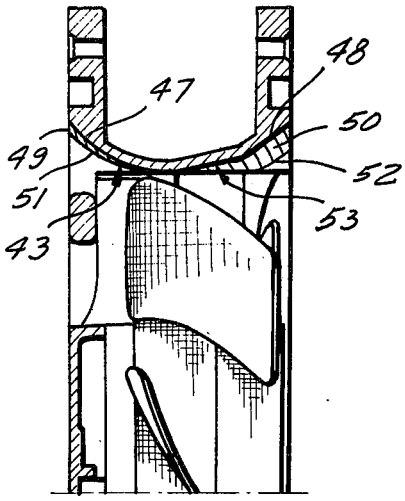
FIG. 7 is a view corresponding to FIG. 3, but of the embodiment shown in FIG. 6.

FIGS. 6 and 7 depict part of a second embodiment which differs from the first embodiment, in matters pertinent for an explanation of the invention, only in that the tubular part 40 is narrowed at a waist 41 in the manner of a venturi nozzle. The waist 41 very closely surrounds the outer peripheral contour (e.g., 12 in FIG. 4) of the fan wheel 42. Proceeding in direction from the waist 41 toward the suction side 44 of the fan, the tubular part 40 widens out, all around the circumference of the waist 41, within the range denoted by 45 in FIG. 6. At the discharge side of the waist 41, the tubular part 40 likewise widens out, all around the circumference of the waist 41, within the range denoted by 46 in FIG. 6. The waist 41 is substantially linear, i.e. it has zero or almost zero axial length, so that the regions 45, 46 directly adjoin each other. These enlargements of the tubular part 40 proceed on in both directions into the eight corners of the construction, so that, as in the first embodiment, there are created additional spaces which are positively utilized in providing flow-guiding elements therein. The two enlargements 48, 47 visible in FIG. 7, each associated with a different one of the eight corners, are each provided with a respective guide element 49, 50, shown sectioned in FIG. 7 inasmuch as these are located symmetrical with respect to the section plane of FIG. 7, which is also the case with the guiding elements 17 and 27 in FIG. 3.

These guiding elements, as do all the others in this embodiment, project over the space created by the corner enlargements inward into the annular intermediate space 43 or 53. These annular spaces at the periphery of the fan wheel are located on both axial sides of the waist and formed by the annular enlargements and adjoin each other substantially directly along the linear waist 41. Whereas the flow-guiding elements of the first embodiment, as shown particularly clearly in FIG. 3 with respect to the guiding elements 17 and 27, project with the entirety of the edges thereof facing the fan wheel into close proximity to the outer peripheral boundary contour 12 (FIG. 4) of the fan wheel—the corresponding edges 51, 52 in FIG. 7 curve radially outward as one proceeds in direction toward the respective axial end of the tubular part 40. In the first embodiment, the cross-sectional surfaces of the flow-guiding elements fully utilize the space created by the enlargement in the corners, and the guiding elements of the first embodiment extend only over this space. In the embodiment of FIGS. 6 and 7, however, the space created in the corners is only partly utilized; this is in many practical applications sufficient for achieving the desired result, namely forced guidance of the air flow in the corner portions of the fan, but it is positively superior with respect to lower operating noise.

The corners not depicted in FIGS. 6 and 7 are provided with flow-guiding elements exactly as depicted in FIG. 7.

Figure 8:
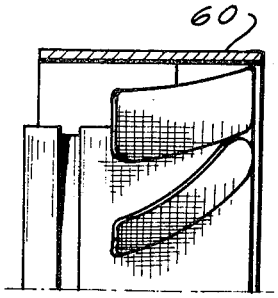
FIG. 8 is a view corresponding to FIG. 2, but of a third embodiment.
Figure 9:
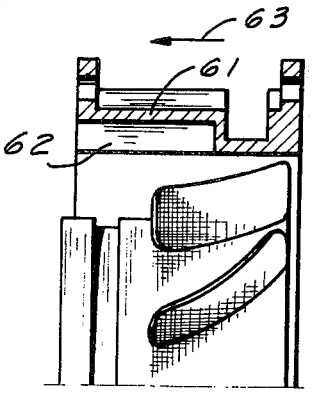
FIG. 9 is a view corresponding to FIG. 3, but of the embodiment shown in FIG. 8.

In the embodiment of FIGS. 8 and 9, the otherwise circular tubular part 60 is enlarged only in the four corners at the discharge side of the fan, and this enlargement 61 is, as can be seen in FIG. 9, provided with a stepped-back offset. In each one of these enlargements, i.e., at all four corners, there are provided two flow-guiding elements arranged parallel one next to the other, to define an intermediate flow channel. In FIG. 9, one of the two guiding elements 62 of the corner portion depicted is visible, whereas the other is located forward of the sectioning plane and therefore cannot be seen. The other (non-illustrated) corners of the discharge side of the fan are designed exactly the same as the illustrated corner and provided with the same arrangement of guiding elements. No enlargements are provided on the intake side of the fan. The flow direction is indicated by arrow 63.

In the embodiment of FIG. 1, the outer edges 39 of the fan blades are oriented at an acute angle relative to the inner edges, e.g. 38, of the flow guiding elements during movement of the fan blades. Accordingly, as the fan wheel turns, the point of closest proximity between the outer edge 39 and the inner edge 38 shifts along the length of the edge 38. This has proved very advantageous in counteracting the generation of noise. This advantageous effect can be still further increased, inter alia, by making the aforementioned acute angle as large as possible, i.e., almost 90°.

Figure 10:
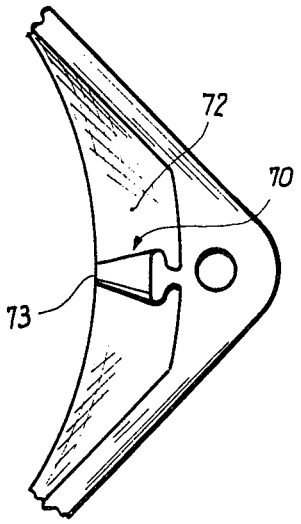
FIG. 10 is a view of another construction for the flared enlargement of the tubular part of the fan, viewed in the same sense as indicated by arrow IV in FIG. 1.

In the embodiments described above, the flow-guiding elements are straight ribs of uniform thickness. However, other configurations are advantageous for the guiding elements, e.g. as shown for the element 70 in FIG. 10. There, the element 70 relative to the plane of FIG. 10 has at the end of the tubular part 72 a pill-shaped cross-section and, maintaining this cross-section extends to its other end 73.

Figure 11:
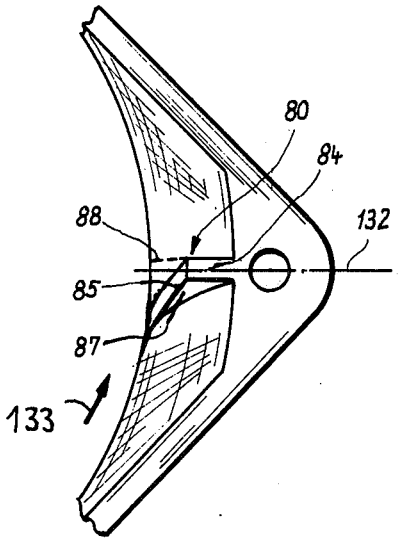
FIGS. 11–16 are views corresponding to FIG. 10, but of six further alternative constructions.

In FIG. 11, the flow-guiding element 80, whose end face 84 within the outlet plane of the fan (likewise the plane of illustration in FIG. 11) extends radially, has a generally axial inner face edge 85 which curves away from the purely radial direction in the direction of rotation of the fan wheel of FIG. 1. As a result, the aforementioned acute angle is increased and the discharged air is deflected from the circumferential direction via the concave surface 87 into the axial delivery direction more steadily and more strongly.

Figure 12:
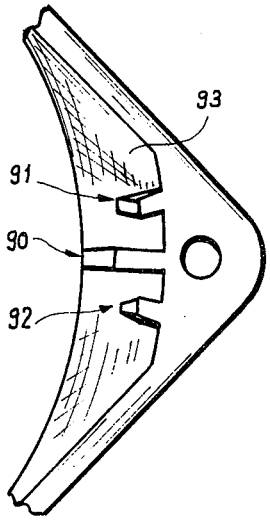

FIG. 12 depicts three flow-guiding elements arranged in a corner 93. The middle one 90 extends over the entire available space, whereas the outer ones 91, 92 only partly utilize the available space.

FIGS. 13–16 are axial views of a corner portion of the fan at the discharge side thereof, each showing a different embodiment, the fan wheel not being illustrated for the sake of simplicity, but forming a cylindrical envelope, as in the embodiment of FIGS. 1–5.

Figure 13:
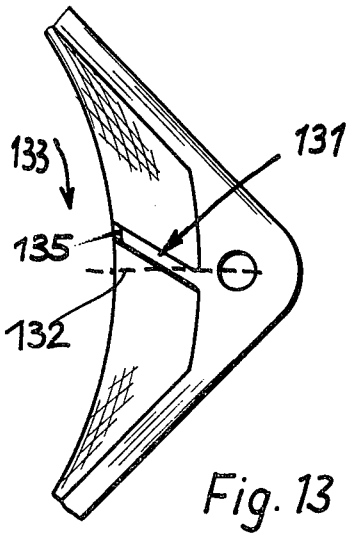
Figure 14:
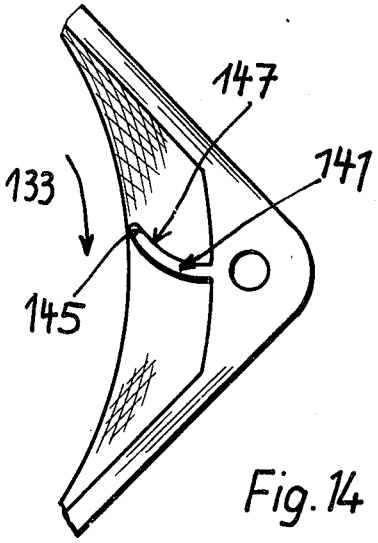
Figure 15:
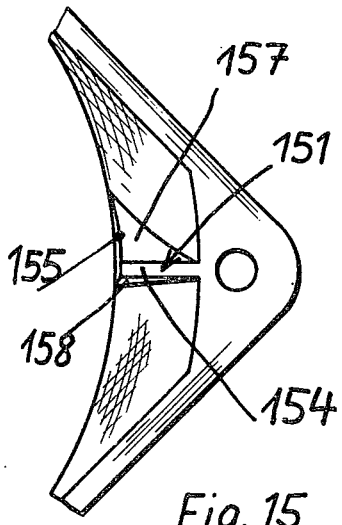

However, opposite to the situation in FIG. 1, in FIGS. 13–15 the fan wheel is assumed to turn in the clockwise direction. Accordingly, the inclination of the fan blades as viewed in the axial direction is changed by approximately 90°, so that, proceeding from the fan-blade edge ends facing the viewer, the fan blades become more distant from the viewer in the clockwise direction (whereas this occurs in the counterclockwise direction in FIG. 1).

FIG. 13 depicts a non-radial flat flow-guiding element 131 oriented at an angle relative to the radial direction 132 in direction opposite to the rotary direction of the fan wheel indicated by arrow 133. This embodiment makes for a better inflow of air into the housing, or a better outflow of air from the fan wheel, as the case may be. The inner end face 135 extends generally axially. It forms with each radially outer edge of each fan blade a sort of intersection point (as viewed in the radial direction), i.e., where these two edges most closely adjoin. The angle between these edges at the intersection point (on the boundary envelope surface of the fan wheel) should be as nearly 90° as possible. During fan wheel rotation, the point of intersection shifts in the air-flow direction.

FIG. 14 depicts a flow-guiding wall 141 curved somewhat in the manner of a Pelton turbine which at the flow off location from the fan wheel is oriented more in the direction of air flow than is the case in FIG. 13.

The deflection of the flow at the concave surface 147 into the radial direction can be combined with the deflection of the flow from the rotation direction into the axial direction (towards the viewer) if the end face or edge 145 is in addition axially curved, as in FIG. 11 but with opposite curvature.

Because such a flow-guiding element is difficult to mold or cast, FIG. 15 depicts an embodiment provided with such an edge 155 of a guiding element 151 inclined in the rotation direction (arrow 133). The surface 157 which rises up out of the purely circumferential direction produces a steady and effective redirection of the flow into the axial direction. Also, the edge angle at the aforementioned point of intersection can be easily given a low-noise value approaching 90° (approximately perpendicular) without creating particular production problems. A still further curving of the end edge 154, in the manner of FIG. 14, would still further increase the effectiveness of the flow-guiding element 151.

FIG. 15 depicts the guide wall 151 completely back cast (of the flat generally radially extending surface 158), which can be produced using simpler tools. The same could be done for the guide element 80 of FIG. 11, which would result in the axially extending edge 88 (shown in broken lines) forming a boundary.

Figure 16:
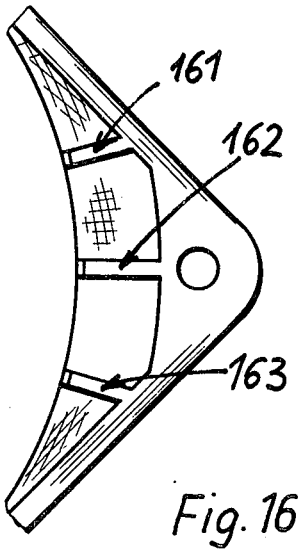

FIG. 16 depicts three radial guide walls 161, 162, 163 uniformly spaced within the illustrated quadrant. This greater number of guide elements is particularly effective when the fan wheel has a large number of blades.

Figure 17:
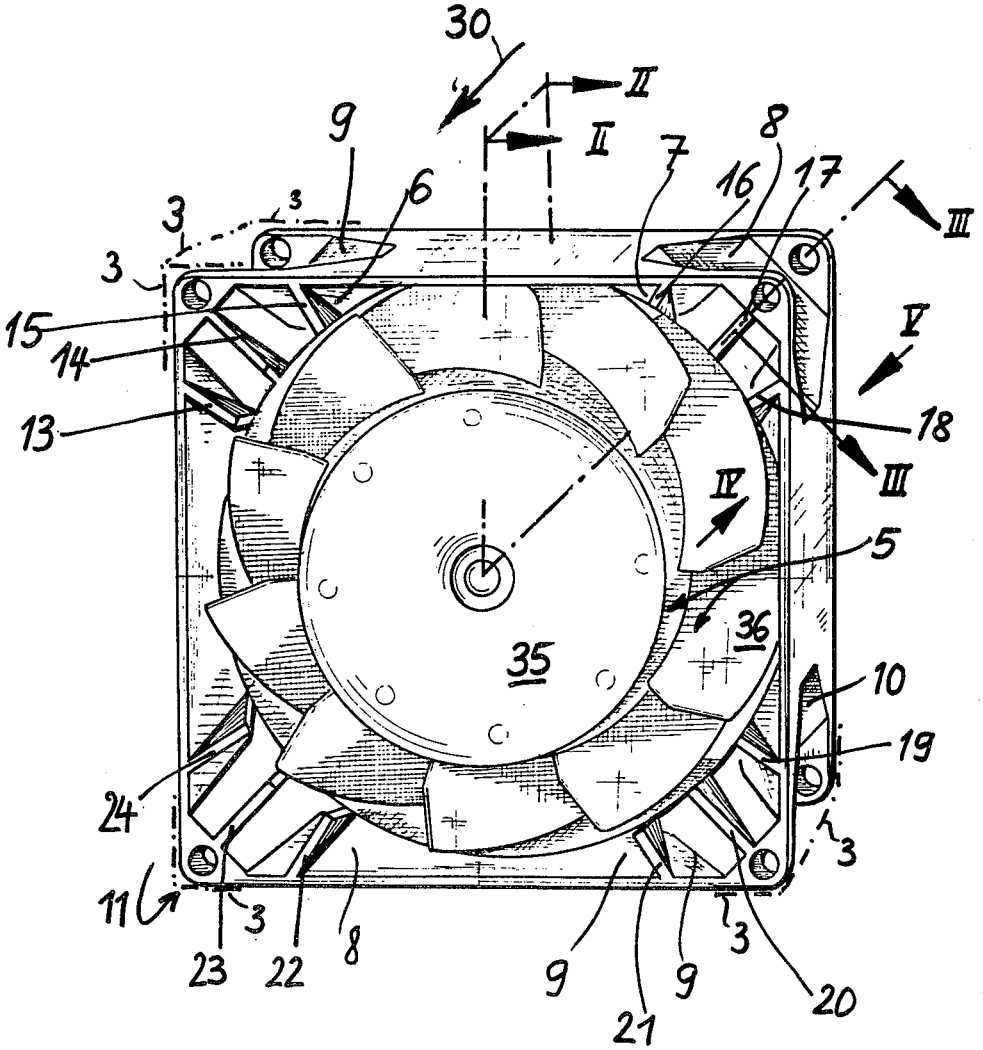
FIG. 17 is a view corresponding to FIG. 1, but of another embodiment incorporating the construction shown in FIG. 16 for the flared enlargement of the tubular part of the axial fan, such as can be very advantageous if provided on the back side (discharge side) of the flow direction reversed.

FIG. 17 is a view similar to FIG. 1, but incorporating the embodiment of FIG. 16. Components corresponding to those in FIG. 1 are denoted by the same reference numerals. In FIG. 1, in contrast to FIG. 17, the guide elements are more or less concentrated in the middle of each corner enlargement. This is advantageous when higher pressures are to be generated.

The flow-guiding elements of the invention are particularly effective when used at the discharge side of the fan. In certain cases, and in contradistinction to what has been explained above with respect to certain ones of the embodiments, it may even be advantageous to provide them only on the discharge side of the fan.

It will be understood that each of the elements described above, or two or more together, may also find a useful application in other types of constructions differing from the types described above.

While the invention has been illustrated and described as embodied in a particular type of fan, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An axial fan comprising, in combination, a fan housing having a generally circular inner peripheral contour and provided with a plurality of substantially identical equally spaced radial projections and having at each axial end of the housing a boundary surface and including a tubular part extending in the axial direction of the fan housing intermediate the two boundary surfaces, a drive motor and radial spokes mounting the drive motor centrally at the boundary surface at one axial end of the housing, a fan wheel driven by the motor and at least partly surrounding the motor and provided with fan blades accommodated in an annular flow channel defined intermediate the tubular part and the drive motor, the fan blades extending substantially all the way to the other axial end of the tubular part of the fan housing, the tubular part approximately midway between its axial ends having a circular interior cross-section closely surrounding the outer peripheral boundary surface of the fan blades, the radial projections being located at at least one of the two axial ends of the fan and the tubular part merging into the radial projections, the inner wall of the tubular part in the vicinity of the radial projections being set back radially outward from the outer peripheral boundary surface of the fan blades but being confined within the outer boundary surface of the fan housing, and further including stationary flow-guiding ribs provided on the set back parts of the tubular part of the fan housing and located in their entirety radially outward of the outer peripheral boundary surface of the fan wheel.

2. The axial fan defined in claim 1, the flow-guiding ribs being provided at the discharge side of the tubular part of the fan housing.

3. The axial fan defined in claim 2, the outer boundary surface of the fan housing being quadratic.

4. The axial fan defined in claim 2, the outer contour of the fan housing being circular with two diametrically oppositely located projections.

5. The axial fan defined in claim 3, the two axial boundary surfaces of the fan housing having the outline of the outer contour of the housing and the projections being provided with mounting elements.

6. The axial fan defined in claim 2, the circular inner cross-section of the tubular part of the fan housing, at least from the portion thereof midway between its axial ends towards the discharge-side end thereof, closely surrounding the outer peripheral boundary surface of the fan wheel except in the region of the flow-guiding ribs.

7. The axial fan defined in claim 6, the internal wall of the tubular part of the fan housing being cylindrical and the outer contour of the fan housing substantially circumscribing this cylinder.

8. The axial fan defined in claim 2, the tubular part of the fan housing having at the portion thereof midway between its axial ends a narrowed waist which closely surrounds the outer peripheral boundary surface of the fan wheel, the projections of the tubular part forming enlargements, the enlargements and the fan wheel defining an intermediate annular diffusor-like space, the flow-guiding ribs projecting into the diffusor-like space.

9. The axial fan defined in claim 2, one of the projections forming an enlargement which in direction towards the associated axial end of the tubular part is of increasing cross-section and is provided with flow-guiding ribs which increase in cross-section in the same direction.

10. The axial fan defined in claim 1, the flow-guiding ribs having edges which face toward the fan wheel and which are oriented relative to the outer peripheral boundary surface of the fan wheel at an angle to the outer edges of the fan blades of the fan wheel.

* * * * *